United States Patent [19]

Cowan

[11] Patent Number: 4,982,436

[45] Date of Patent: Jan. 1, 1991

[54] DUAL HORN FOLDED SOUNDPATH LOUDSPEAKER

[75] Inventor: James P. Cowan, Glen Mills, Pa.

[73] Assignee: Gai-Tronics, Reading, Pa.

[21] Appl. No.: 280,142

[22] Filed: Dec. 5, 1988

[51] Int. Cl.[5] ..... G10K 11/00

[52] U.S. Cl. ..... 381/156; 181/194; 181/195

[58] Field of Search ..... 381/156, 153, 154; 181/194, 192, 195

[56] References Cited

U.S. PATENT DOCUMENTS

| | | | |
|---|---|---|---|
| 1,625,325 | 4/1927 | McCartney et al. | 181/194 |
| 1,628,010 | 5/1927 | Taylor | 181/194 |
| 1,653,144 | 12/1927 | Bach | 181/194 |
| 1,748,790 | 2/1930 | Osborne | 181/194 |
| 1,759,614 | 5/1930 | Hall | 181/194 |
| 1,772,645 | 8/1930 | Stevens | 181/194 |
| 1,813,208 | 7/1931 | Smythe | 181/195 |
| 2,338,262 | 1/1944 | Salmon | 181/192 |
| 2,638,510 | 5/1953 | Brami | 381/156 |
| 2,746,558 | 5/1956 | Levy | 381/156 |
| 2,751,996 | 6/1956 | Levy | 181/194 |
| 2,858,377 | 10/1958 | Levy | 381/194 |
| 4,309,932 | 1/1982 | Keele | 181/187 |
| 4,378,471 | 3/1983 | Shintaku | 381/156 |
| 4,385,211 | 5/1983 | Shintaku | 381/156 |

FOREIGN PATENT DOCUMENTS

| | | | |
|---|---|---|---|
| 560727 | 4/1944 | United Kingdom | 381/156 |
| 742889 | 1/1956 | United Kingdom | 381/156 |
| 2073541 | 10/1981 | United Kingdom | 381/156 |
| 2145905 | 4/1985 | United Kingdom | 381/156 |

OTHER PUBLICATIONS

Keele, D. B., "What's So Sacred About Exponental Horns", Audio Engineering Society, Preprint No. 1038 (2-3), pp. 1-32 (1985).

Product Literature for the ATLAS BIA-100 Bi-Axial Horn.

Product Literature for the University Sound Cobreflex IIB Folded Sectoral Horn.

Product Literature for the University Sound Cobreflex III Folded Sectoral Horn.

*Primary Examiner*—Forester W. Isen

*Attorney, Agent, or Firm*—Woodcock Washburn Kurtz Mackiewicz & Norris

[57] ABSTRACT

A loudspeaker having two horns defining two soundpaths passing therethrough an input for connection to a driver and an output for broadcasting an acoustic signal is shown to include a central channel connected at one end to the input, the soundpaths being coincident therethrough and a first transition member which defines separate channels for the soundpaths. Such separate channels serving to change the direction of the soundpaths. There is also shown a pair of side channels, the cross-section of the output ends of the side channels are defined by first and second dimensions, wherein the first dimension is larger than the second dimension. A pair of second transition members serve to again change the direction of the soundpaths. Such transition members have an output end defined by first and second dimensions wherein the second dimension is larger than the first dimension. A pair of main channels and a pair of flared outer channels having walls which follow the arc of a circle of constant radius complete the soundpath. Each channel has a cross sectional area which increases outwardly along the soundpath so that at any point downstream from the central channel the cross-sectional area at that point is greater than any preceding cross-sectional area and less than any subsequent cross-sectional area. The increase in cross-sectional area is preferred to be linear.

22 Claims, 23 Drawing Sheets

DUAL HORN FOLDED SOUNDPATH LOUDSPEAKER

FIELD OF THE INVENTION

The present invention relates to the field of loudspeakers and more particularly to loudspeakers utilized in industrial applications, i.e. manufacturing plants or mines, which loudspeakers are primarily intended for the reproduction and broadcast of voice communications.

BACKGROUND OF THE INVENTION

Sound or audio communication in the industrial workplace has become a primary management concern, particularly in the area of voice communications. Providing information through voice broadcasts can have a direct impact on safety and production. Accordingly, a need exists for systems capable of reproducing distinguishable voice communication in an industrial environment. To this end, several sound systems have been developed which will amplify and transmit voice communications throughout a workplace. Although a multitude of environments exist in which such systems have been utilized, for purposes of the description herein it is assumed that such a system is being incorporated into a manufacturing assembly plant.

Generally sound systems designed for assembly plant use include a signal source (microphone, tape deck, etc.), an amplifier, appropriate cabling and a series of loudspeakers dispersed throughout the plant. As will be seen, the number and disbursement location of such loudspeakers is dependent upon their broadcast characteristics. The subject of the present invention encompasses only a component part of such voice communication systems, namely the loudspeaker horn. It will be noted that loudspeakers typically have attached a driver unit, for converting the amplified source signal to a sound pressure signal. The driver is usually connected to the input end of the loudspeaker soundpath. The present invention relates only to loudspeaker horn design and not to any particular driver design. As used hereinafter the term "loudspeaker" shall refer only to the horn portion and not to the driver.

The choice and consequently the design of a loudspeaker is typically based on two factors: high efficiency and coverage control or coverage angle. As used herein, high efficiency signifies a high acoustic output with low distortion and coverage angle signifies, in an ideal situation, constant directivity and beamwidth as a function of frequency for the entire intended broadcast area. Broadcast area is that area falling within an angular range, designated by the loudspeaker designer, where the speaker is positioned at the apex of the angular range. Directivity is a sound intensity ratio of the intensity of the sound wave within the intended broadcast area to the intensity of the sound wave over 360°.

Beamwidth plays a significant role in the description of the present invention. It will be noted that beamwidth may be generally defined as encompassing the total angle existing between those directions at which the sound pressure level (SPL) falls below 6 dB from the "head-on" axis (reference direction) SPL. SPL falling below this 6db limit has the acoustic effect of making words contained in a voice broadcast indistinguishable. Typically, speakers designated for use in an assembly plant communication system are rated for vertical and horizontal beamwidth. As can be appreciated, the greater the beamwidth, the fewer number of speakers and related equipment that will be needed to provide coverage throughout the assembly plant. As can be appreciated, to the plant coverage utilizing a minimum number of loudspeakers necessitates a design goal of maximizing beamwidth.

As indicated in Keele, D.B., What's So Sacred About Exponential Horns, Audio Engineering Society Preprint No. 1038 (F-3), pp. 1-32 (1975) an ideal horn should have constant directivity and beamwidth as a function of frequency and provide a constant acoustic load to the driver. A loudspeaker typically is constructed from one or more horns. In the real world, however, design constraints (finite size, materials, reproducible shaping) introduce various performance problems effecting beamwidth which need be minimized for particular loudspeaker applications. Presently, general categories of horns have developed, namely exponential horns of either the multi-cell or radial/sectoral type and conical horns. Keele suggests that certain of the problems associated with these types of horns can be resolved with a hybrid exponential/-conical horn.

U.S. Pat. No. 4,309,932 - Keele discloses a horn having two different exponential flare surfaces oriented 90° to one another. It is indicated that such a design can improve beamwidth because the precise profile of each of the two flare surfaces is achieved by a power series equation which is said to take desired beamwidth into account. However, again the largest beamwidth described in relation to that design is only 90°.

If one moves away from the literature to currently available loudspeakers, it can be seen that maximum beamwidths of less than approximately 100° are available. Along this line three commercially available folded loudspeakers were acquired and tested. Since the present invention is directed primarily to voice communication, the subject loudspeakers were analyzed at frequencies between 500 and 5000 Hz. Utilizing available testing equipment, such as a TEF Analyzer, each loudspeaker was tested to determine loudspeaker frequency response over the 500 to 5000 Hz frequency range at locations on the reference direction and spaced 30° and 60° there from and polar plots were generated to determine beamwidth. All loudspeakers tested incorporated the SSD 1800 driver by Renkus-Heinz of Irvine, California. This driver is preferred because it demonstrates a reliable frequency response in the frequency range of interest.

As shown in Figures 1A-1C, the frequency response of an Atlas Sound BIA-100 Bi-Axial (BIA) loudspeaker was not so-called "flat" signal, which is the desired efficiency response, but varied significantly. As can be seen from FIGS. 2A through 2D, the BIA loudspeaker demonstrated a horizontal beamwidth between 500 and 5000 Hz within a range from approximately 20° to 70°. As shown in FIGS. 3A to 3D, the BIA loudspeaker exhibited a 100° vertical beamwidth in the lowest frequencies but such beamwidth decreased significantly between 3000 and 5000 Hz to approximately 20°. Equipment and techniques for generating polar plots of the type shown in this application are well known. It should be noted that each "ring" in the plots represents 6dB of SPL.

A second loudspeaker, a Cobraflex II B folded sectoral horn, from University Sound (IIB) was also tested. As shown in FIGS. 4A-4C, the frequency response of this loudspeaker did not yield the desired flat response signal for the subject frequency range. As can be seen in FIGS. 5A and 5D the horizontal beamwidth lies within a range of approximately 10° to 70° with the greatest beamwidth occurring at the lowest frequencies. Although better, the vertical beamwidth became significantly limited between 3000 and 5000 Hz the vertical beamwidth fell within the range from approximately 20° to 90°. It should be kept in mind that the frequency range of 500 to 5000 Hz is selected because substantially all voice communications fall within that range.

A third loudspeaker, a Cobraflex III folded sectoral horn also from University Sound (III) was tested. As shown in FIGS. 7A–7C, the frequency response of this loudspeaker although better than IIB, still was not yielding a flat response signal. As shown in FIGS. 8A–8D the horizontal beamwidth was measured to be within the range from approximately 20° to 50°. The vertical beamwidth again became significantly limited between 2000 and 5000 Hz. As shown in FIGS. 9A to 9D, the vertical beamwidth fell within a range from approximately 15° to 75°. It is also desirable to design loudspeakers having a folded soundpath. This is necessary because of horn length and environment considerations.

To achieve desired frequency response in a loudspeaker intended for broadcasting voice communications, an acoustic path of a given length is necessary. When considering space limitations of assembly plants it becomes readily apparent that the acoustic path needs to be folded. Too large a unit simply cannot be accommodated. Also, it is significantly easier for moisture to make contact with the driver in a straight horn versus a horn having a folded path. Moisture contacting the driver can result in driver short circuit and in some cases destroy the driver's transducer.

Consequently, a need exists for a folded loudspeaker which is capable of broadcasting an acoustic signal for which the sound pressure level remains within 6 dB from the "head-on" axis SPL for maximum horizontal and vertical angles.

In the present invention, a horizontal beamwidth of 120° and a vertical beamwidth of 60° are achieved using a new and novel loudspeaker design which also incorporates a folded soundpath. It will be noted that the folded soundpath concept is not new. For example, each of the BIA, IIB and III loudspeakers incorporate a folded soundpath or re-entrant soundpath design. Also, folded soundpaths are disclosed in U.S. Pat. Nos. 2,338,262 - Salmon and 2,751,996 - Levy.

SUMMARY OF THE INVENTION

It is an object of the present invention to provide a loudspeaker having a maximum constant beamwidth for voice communications in an industrial environment.

It is another object of the present invention to provide a loudspeaker having a folded soundpath in which the cross sectional area is constantly increasing from input to output.

It is yet another object of the present invention to provide a loudspeaker having a folded soundpath, which soundpath passes through a transition member having generally reversed aspect ratios from input to output.

These and other objects of the present invention are achieved in a loudspeaker having two horns defining two soundpaths passing therethrough, an input for connection to a driver and an output for broadcasting an acoustic signal. This loudspeaker is shown to include a central channel connected at one end to the input, the soundpaths being coincident therethrough and, a first transition member which defines separate channels for the soundpaths. Such separate channels serve to change the direction of the soundpaths. A pair of side channels is connected to the first transition member. The cross-section of the output ends of the side channels are defined by first and second dimensions, where the first dimension is larger than the second dimension. A pair of second transition members serves to again change the direction of the soundpaths. The second transition members are shown as having an output end also defined by first and second dimensions where the second dimension is now larger than the first dimension. A pair of main channels and a pair of flared outer channels having walls flared along the arc of a circle of constant radius complete the soundpath. Each channel of the loudspeaker has a cross sectional area which increases outwardly along the soundpath so that at any point downstream from the central channel the cross-sectional area at that point is greater than any preceding cross-sectional area and less than any subsequent cross-sectional area. The increase in cross-sectional area is preferred to be linear.

These and other objects and advantages of the invention will become more apparent from the following detailed description when taken in conjunction with the following drawings.

DETAILED DESCRIPTION OF THE PREFERRED EMBODIMENT

Figure 1A:
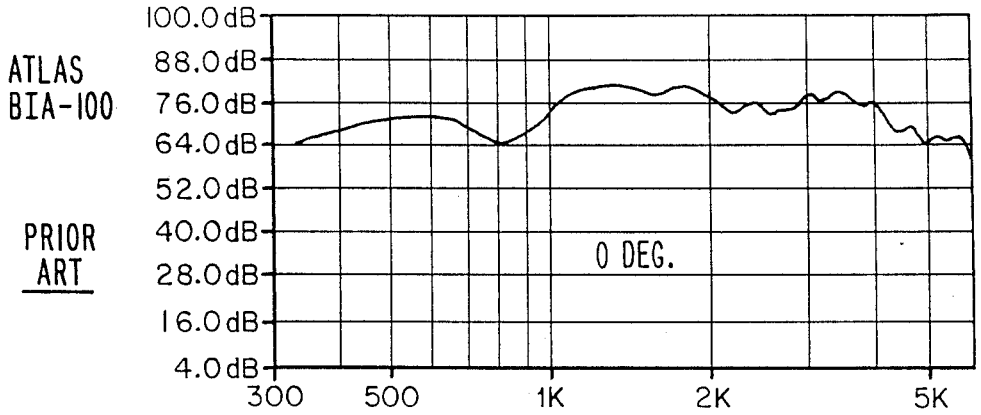
FIGS. 1*a* to 1*c* are graphs of response of a BIA prior art loudspeaker.
Figure 1B:
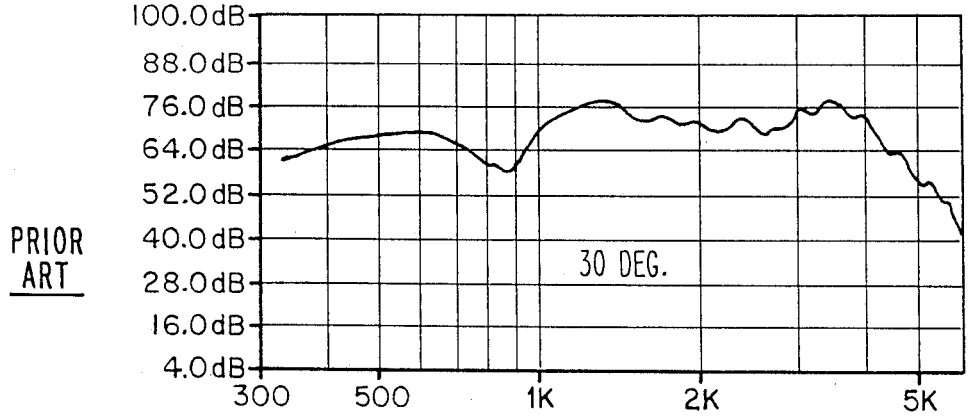
Figure 1C:
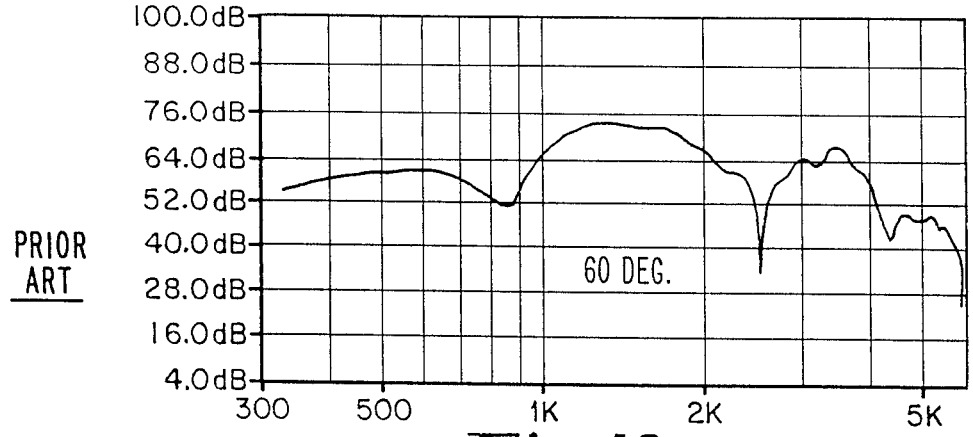
Figure 2A:
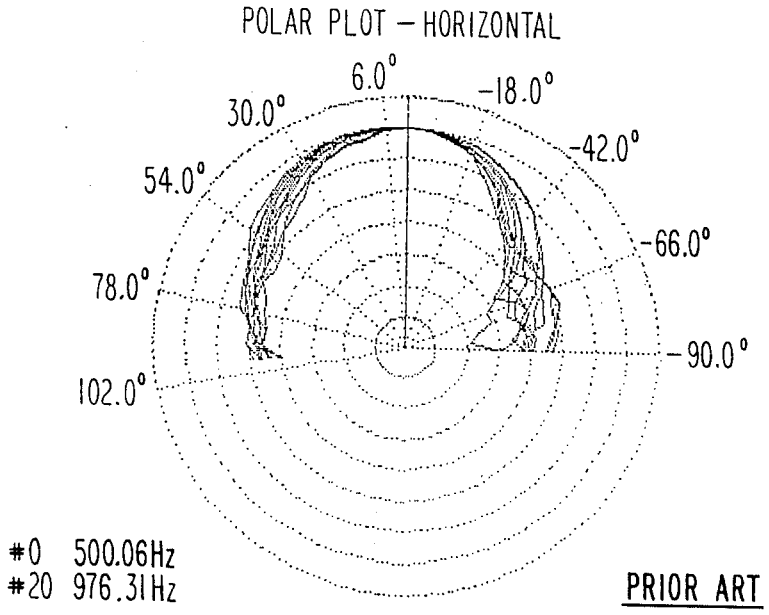
FIGS. 2*a* to 2*d* are polar graphs showing the horizontal beamwidth of a BIA prior art loudspeaker.
Figure 2B:
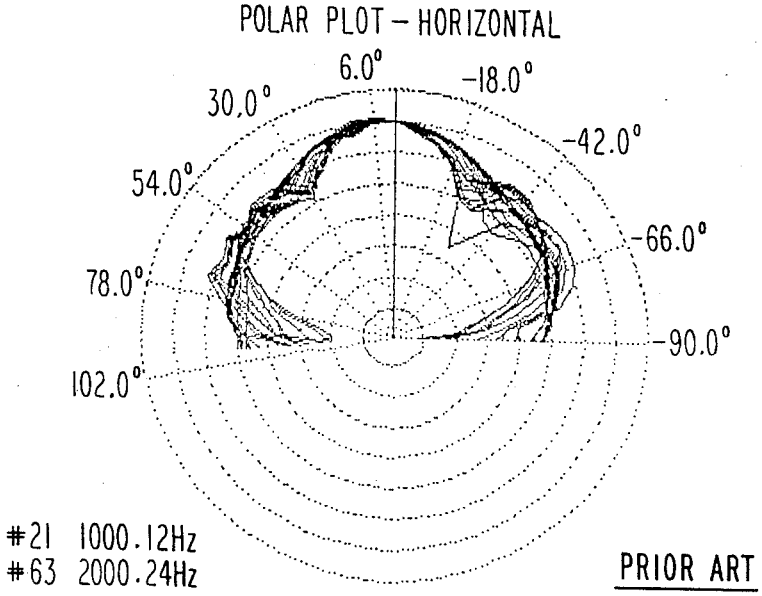
Figure 2C:
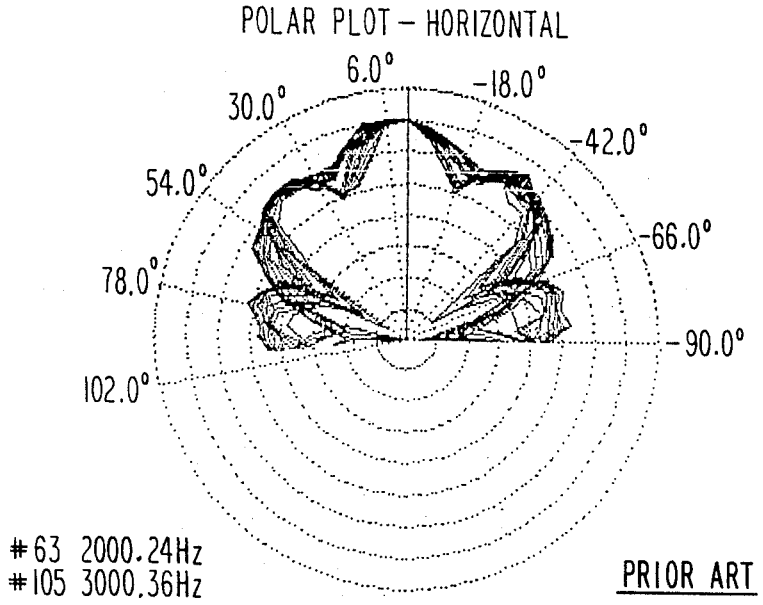
Figure 2D:
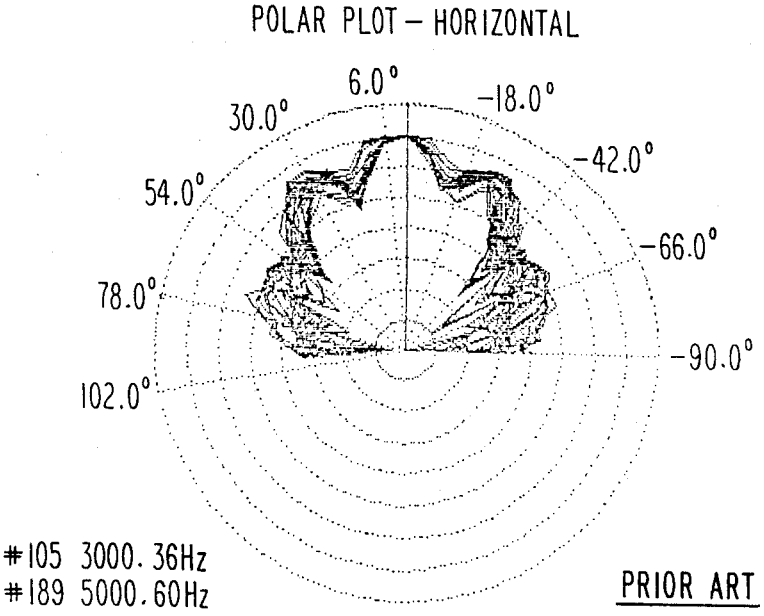
Figure 3A:
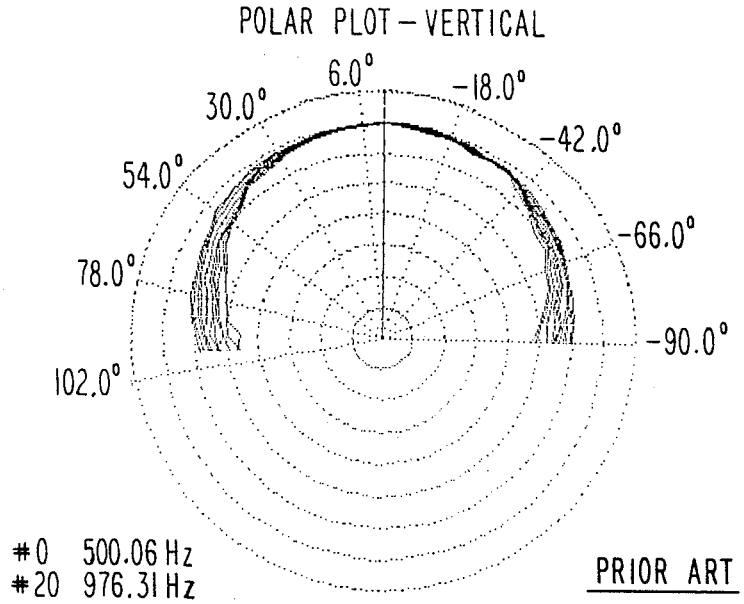
FIGS. 3*a* to 3*d* are polar graphs showing the vertical beamwidth of a BIA prior art loudspeaker.
Figure 3B:
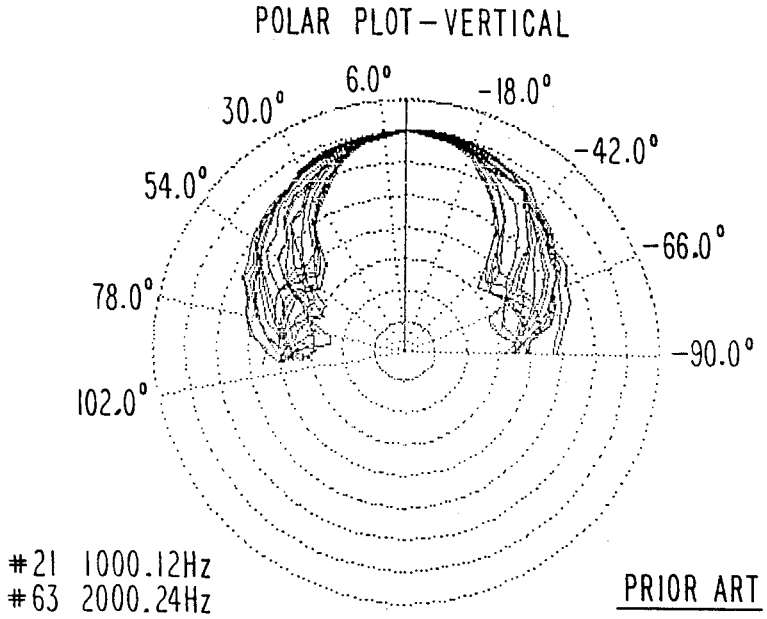
Figure 3C:
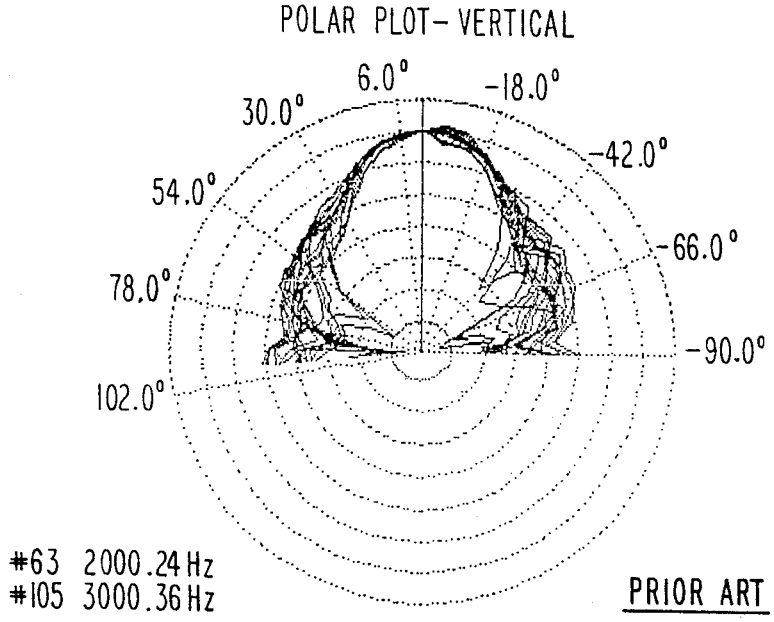
Figure 3D:
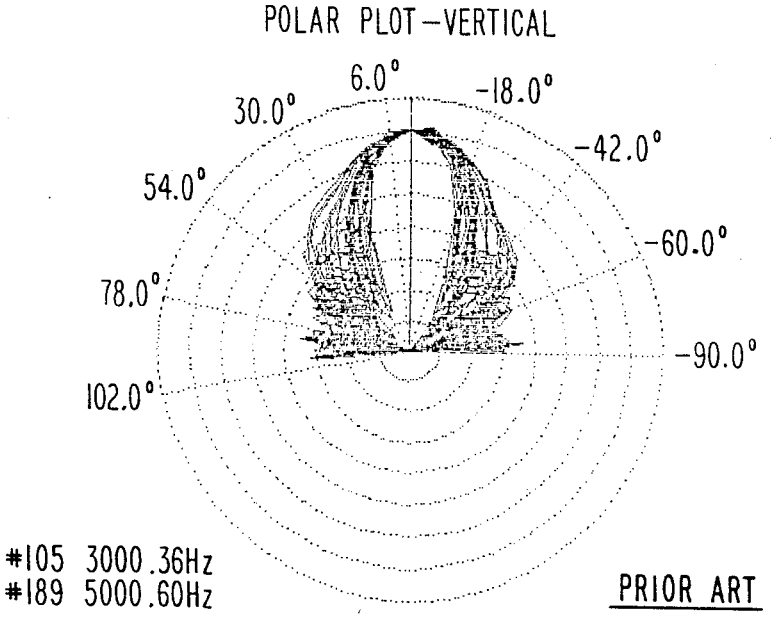
Figure 4A:
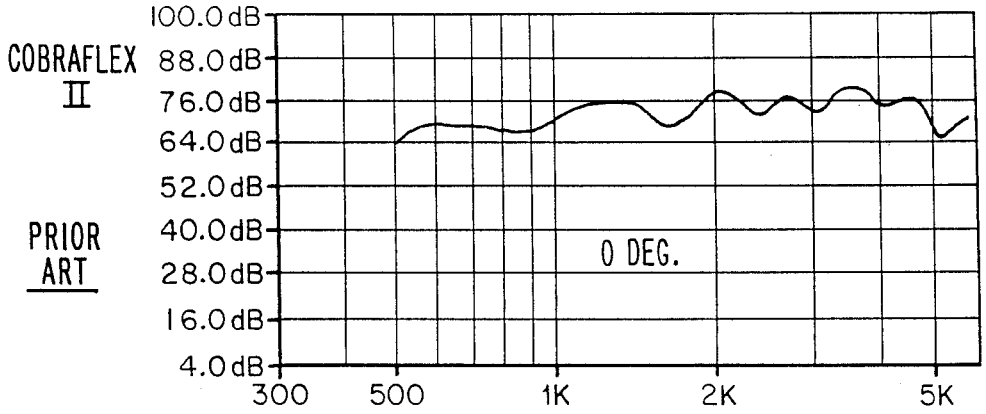
FIGS. 4*a* to 4*c* are graphs of response of a IIB prior art loudspeaker.
Figure 4B:
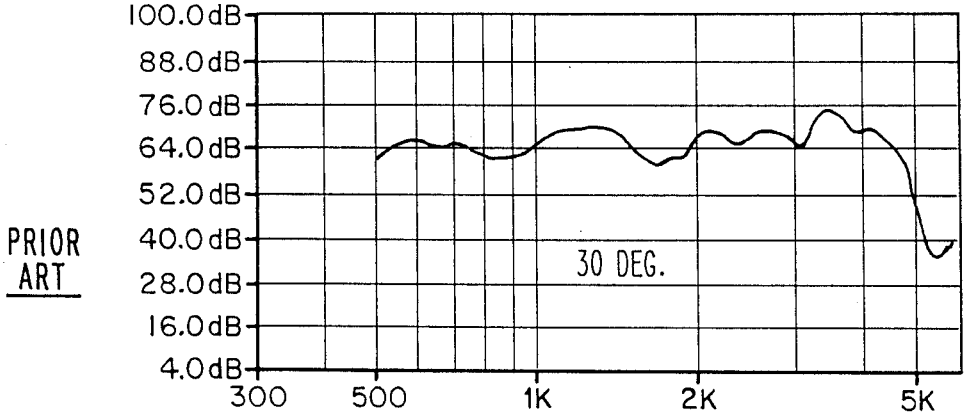
Figure 4C:
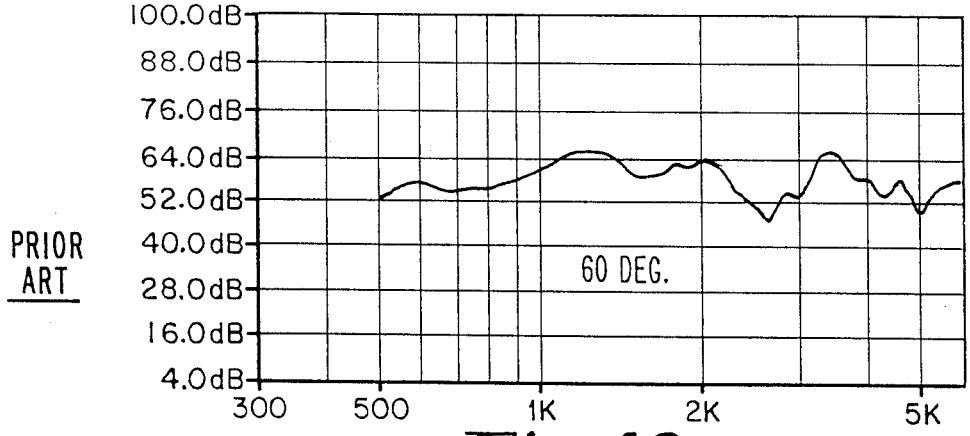
Figure 5A:
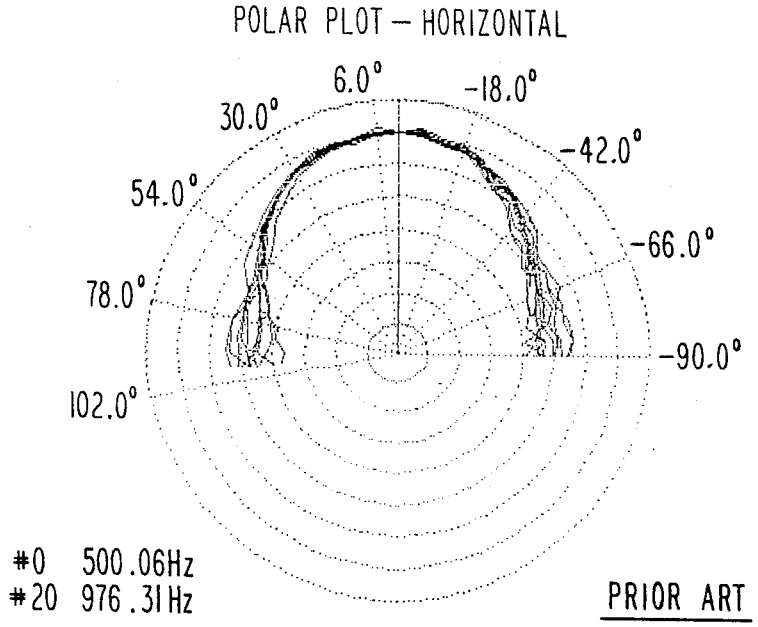
FIGS. 5*a* to 5*d* are polar graphs showing the horizontal beamwidth of a IIB prior art loudspeaker.
Figure 5B:
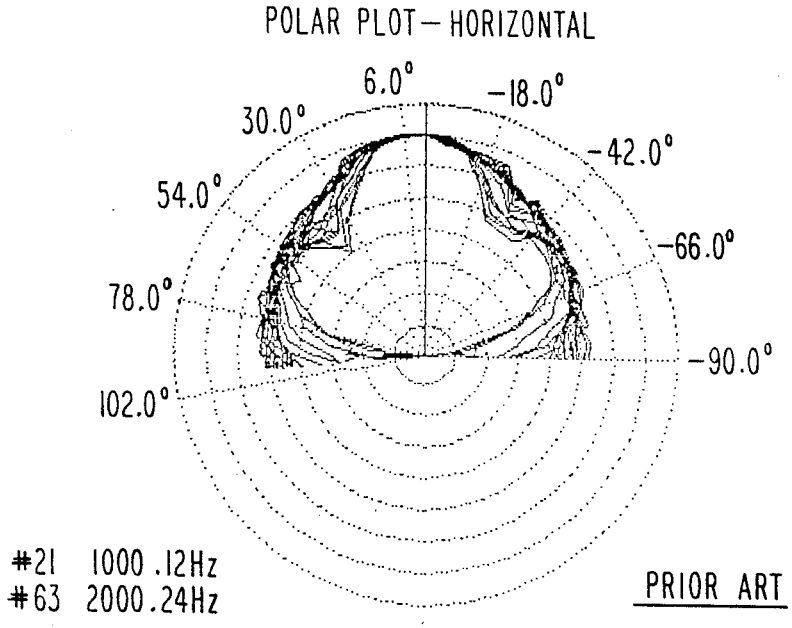
Figure 5C:
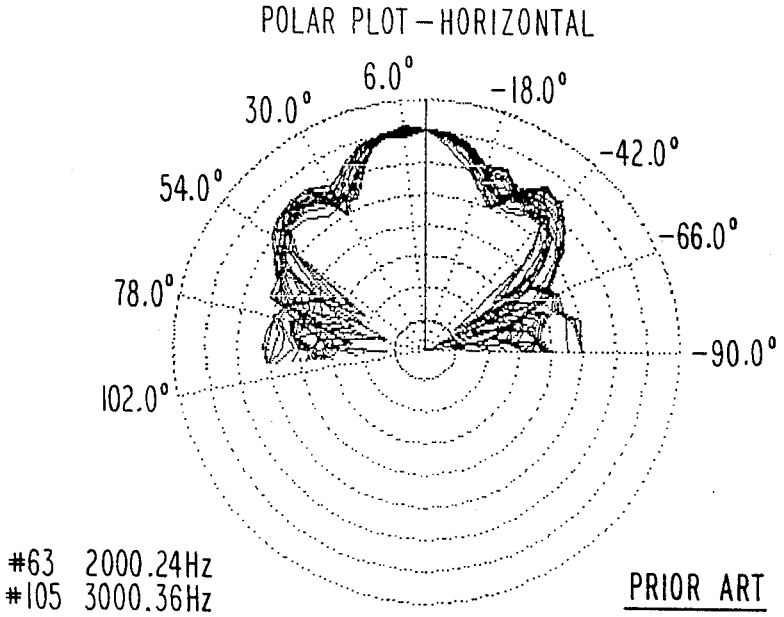
Figure 5D:
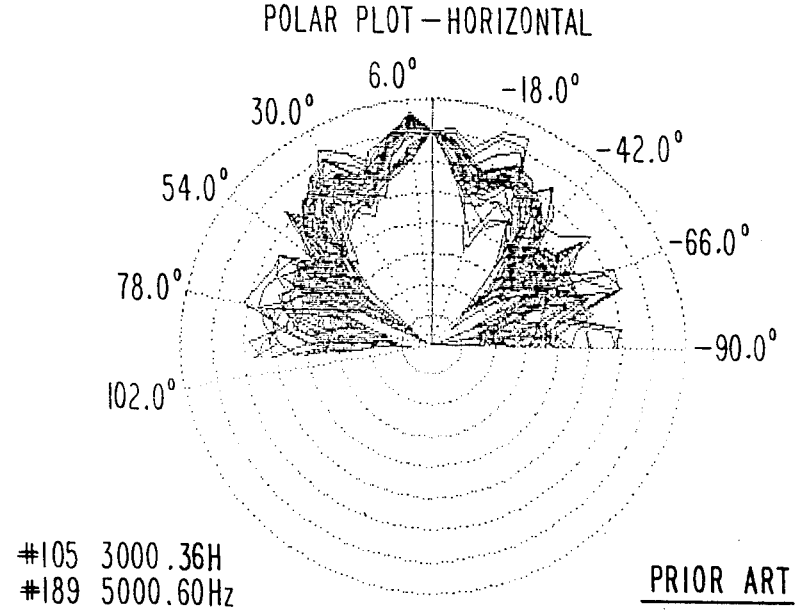
Figure 6A:
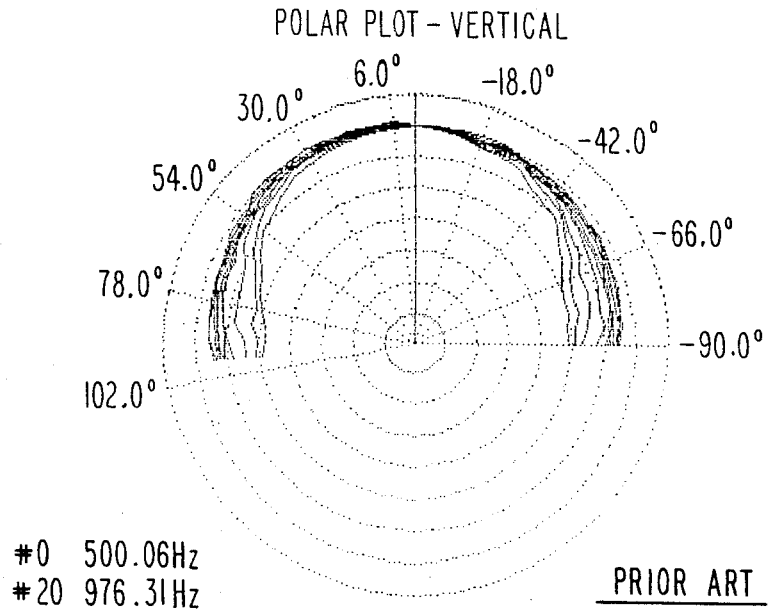
FIGS. 6*a* to 6*d* are polar graphs showing the vertical beamwidth of a IIB prior art loudspeaker.
Figure 6B:
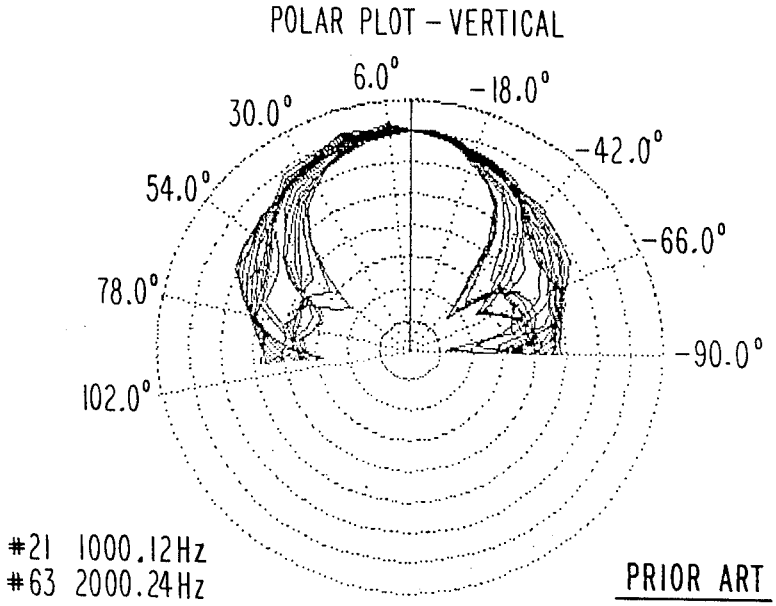
Figure 6C:
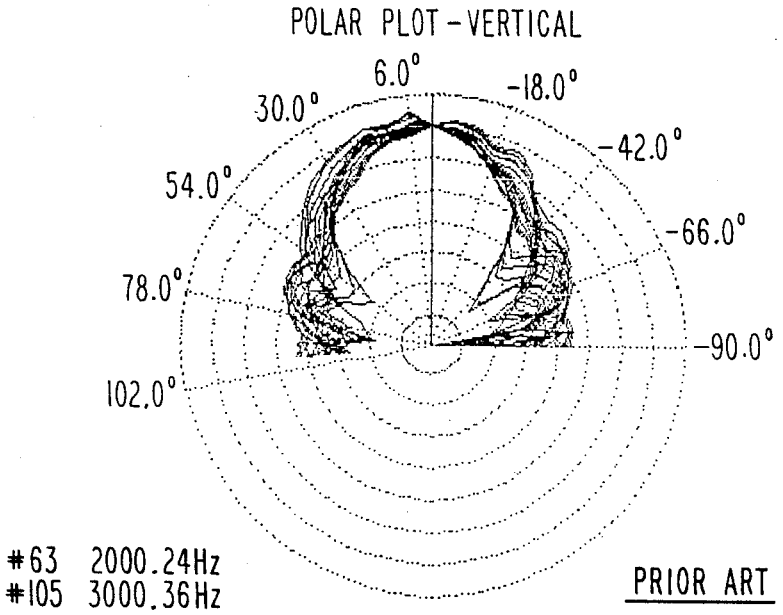
Figure 6D:
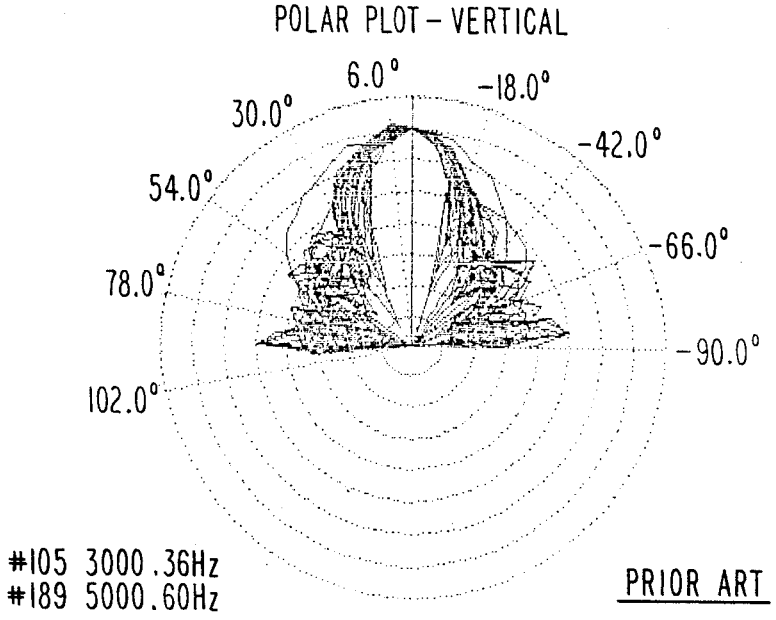
Figure 7A:
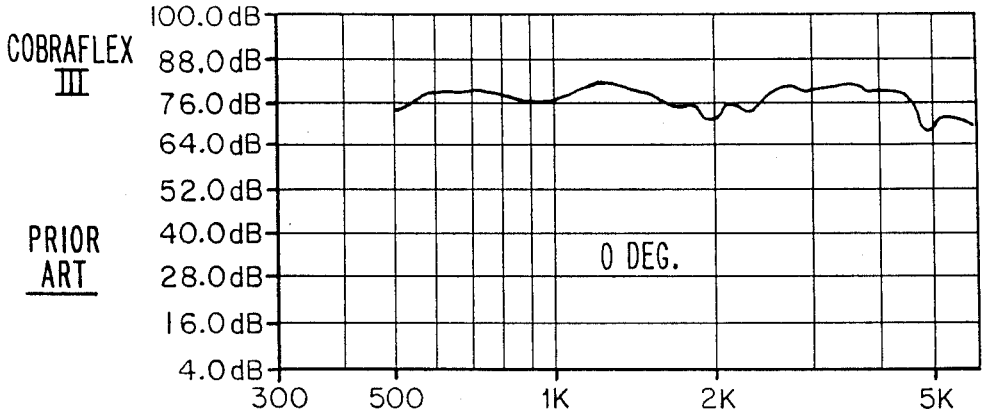
FIGS. 7*a* to 7*c* are graphs of response of a III prior art loudspeaker.
Figure 7B:
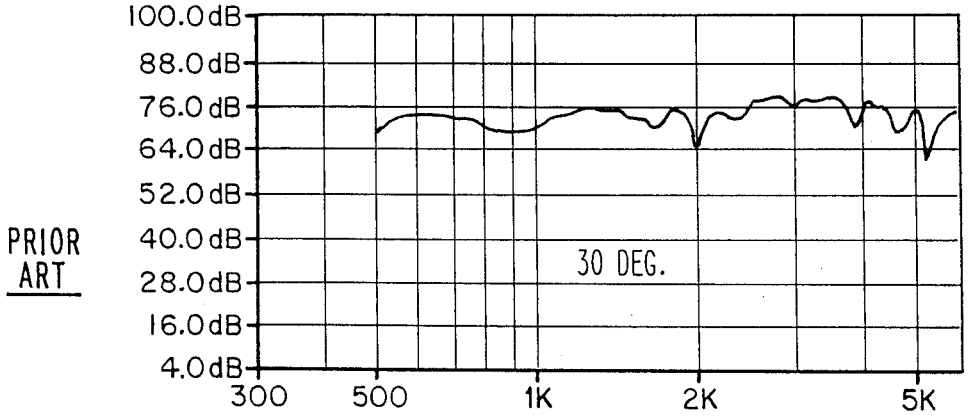
Figure 7C:
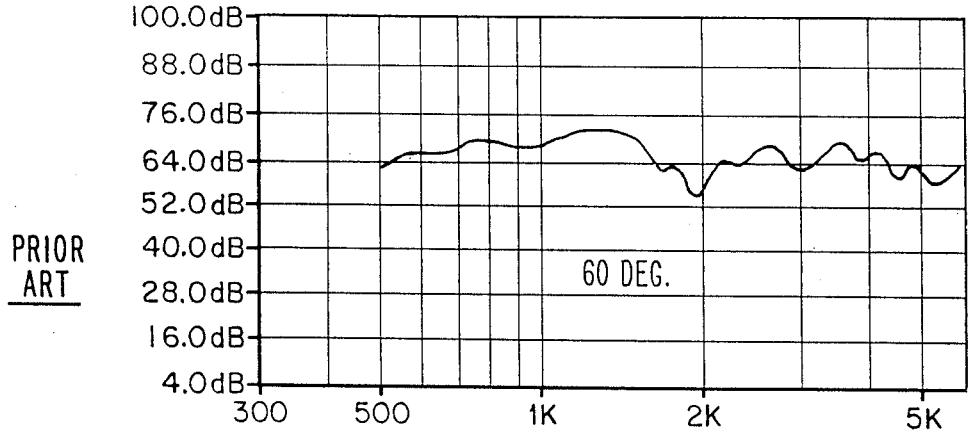
Figure 8A:
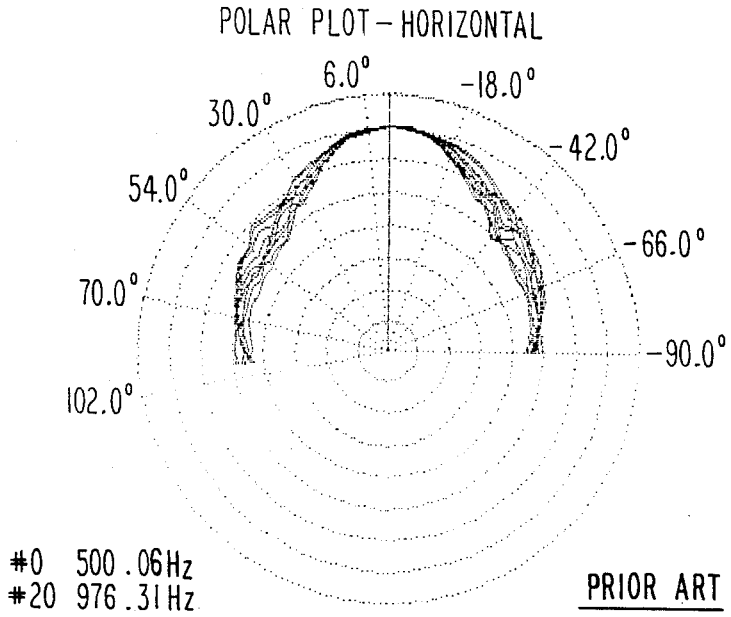
FIGS. 8*a* to 8*d* are polar graphs showing the horizontal beamwidth of a III prior art loudspeaker.
Figure 8B:
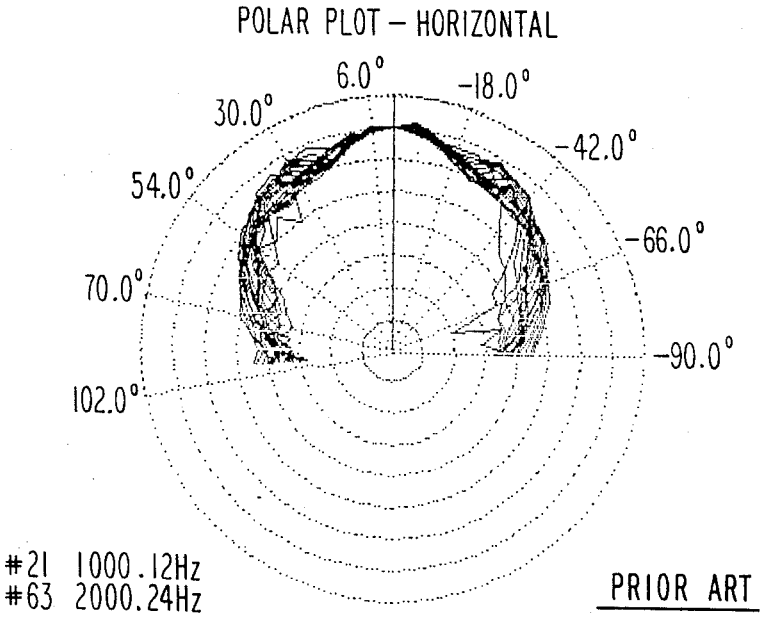
Figure 8C:
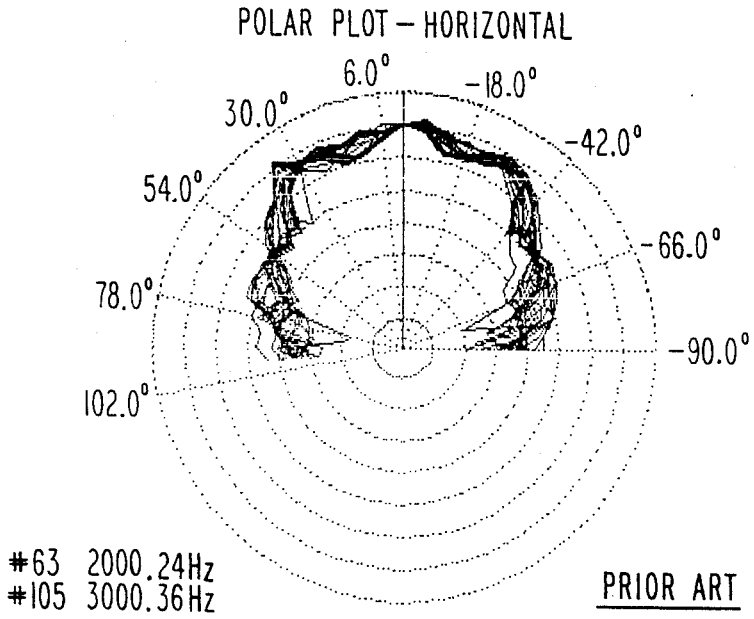
Figure 8D:
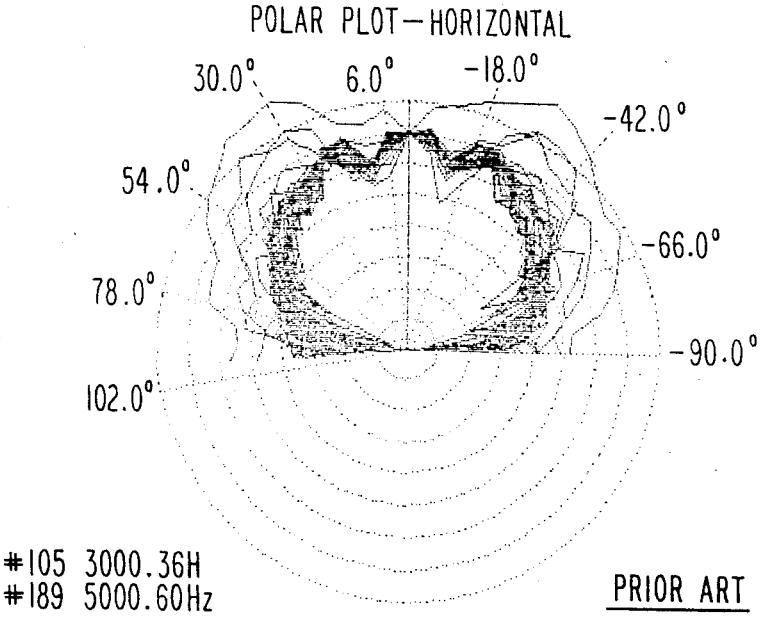
Figure 9A:
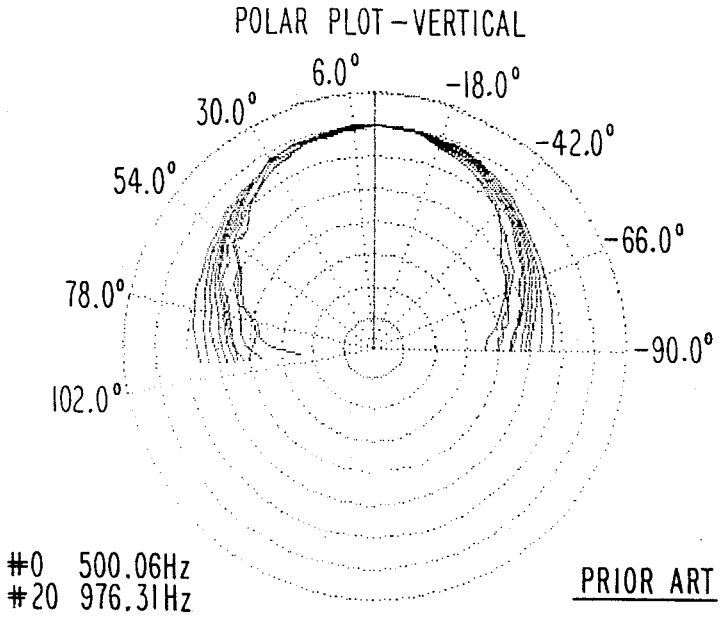
FIGS. 9*a* to 9*d* are polar graphs showing the vertical beamwidth of a III prior art loudspeaker.
Figure 9B:
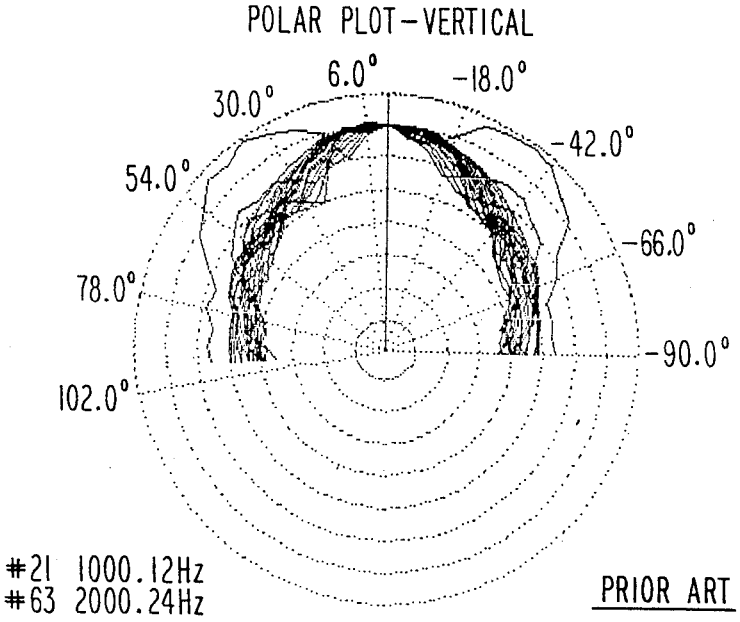
Figure 9C:
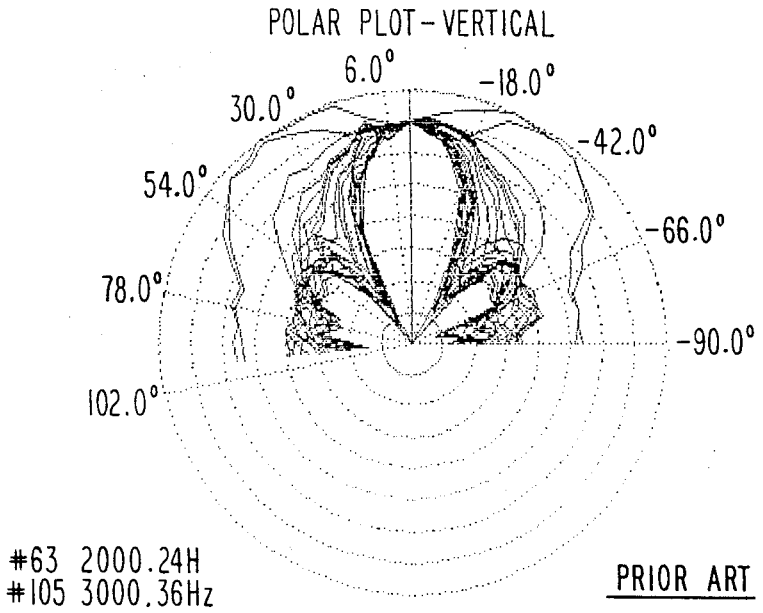
Figure 9D:
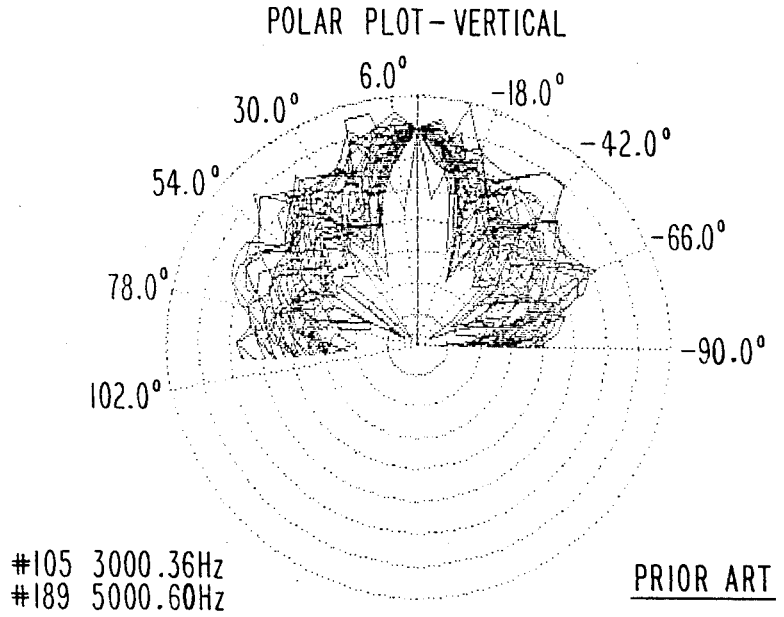
Figure 10:
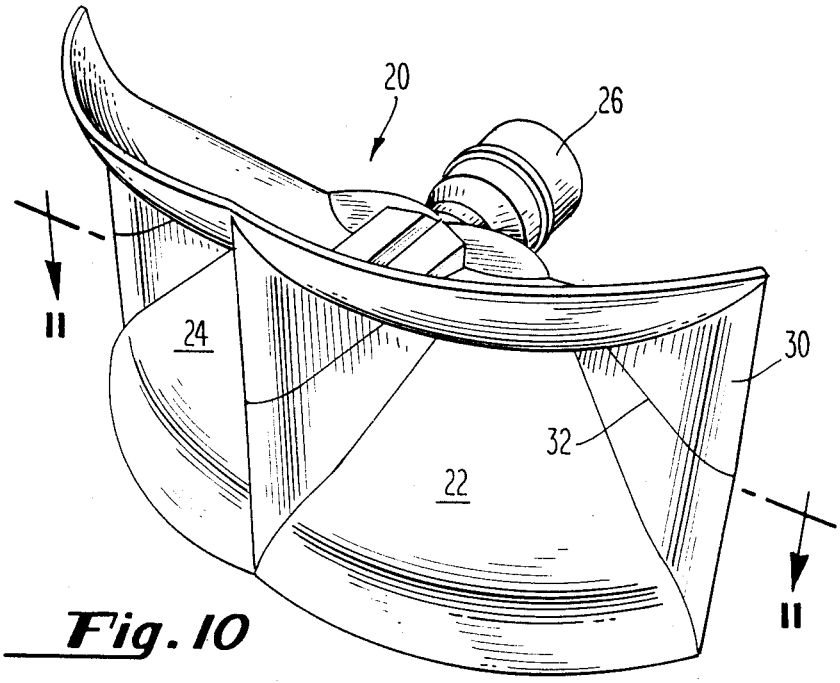
FIG. 10 is a perspective view of a loudspeaker constructed in accordance with the principles of the present invention.

A new and novel loudspeaker constructed in accordance with the principles of the present invention is depicted in FIG. 10 and is generally referred to as 20. The loudspeaker is shown to generally include two horn sections 22 and 24 and a driver unit 26. As has been previously stated, the present invention relates only to loudspeaker design and not to any particular driver design. Although many drivers are capable of providing an acceptable signal within the frequency range of voice communication, namely between 500 and 5000 Hz can be used, the SSD 1800 driver by Renkus-Heinz of Irvine, California or the ID 30C minimum power compression drivers by University Sound of Sylmar, California have been utilized successfully.

Figure 11:
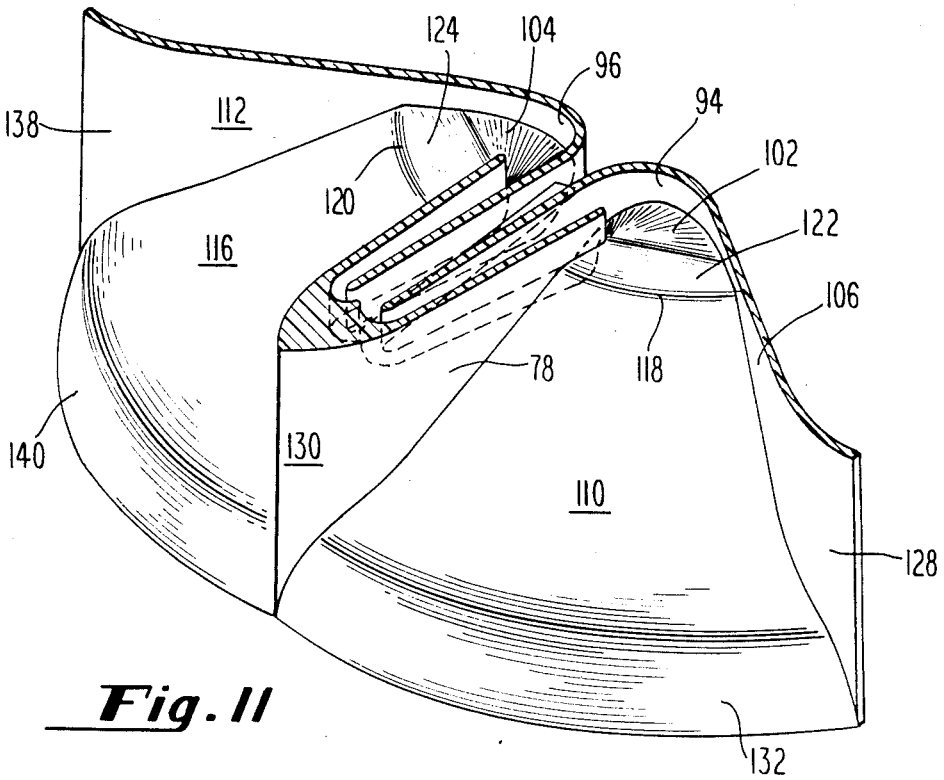
FIG. 11 is a perspective sectional view taken along the line 11—11 of FIG. 10.
Figure 12:
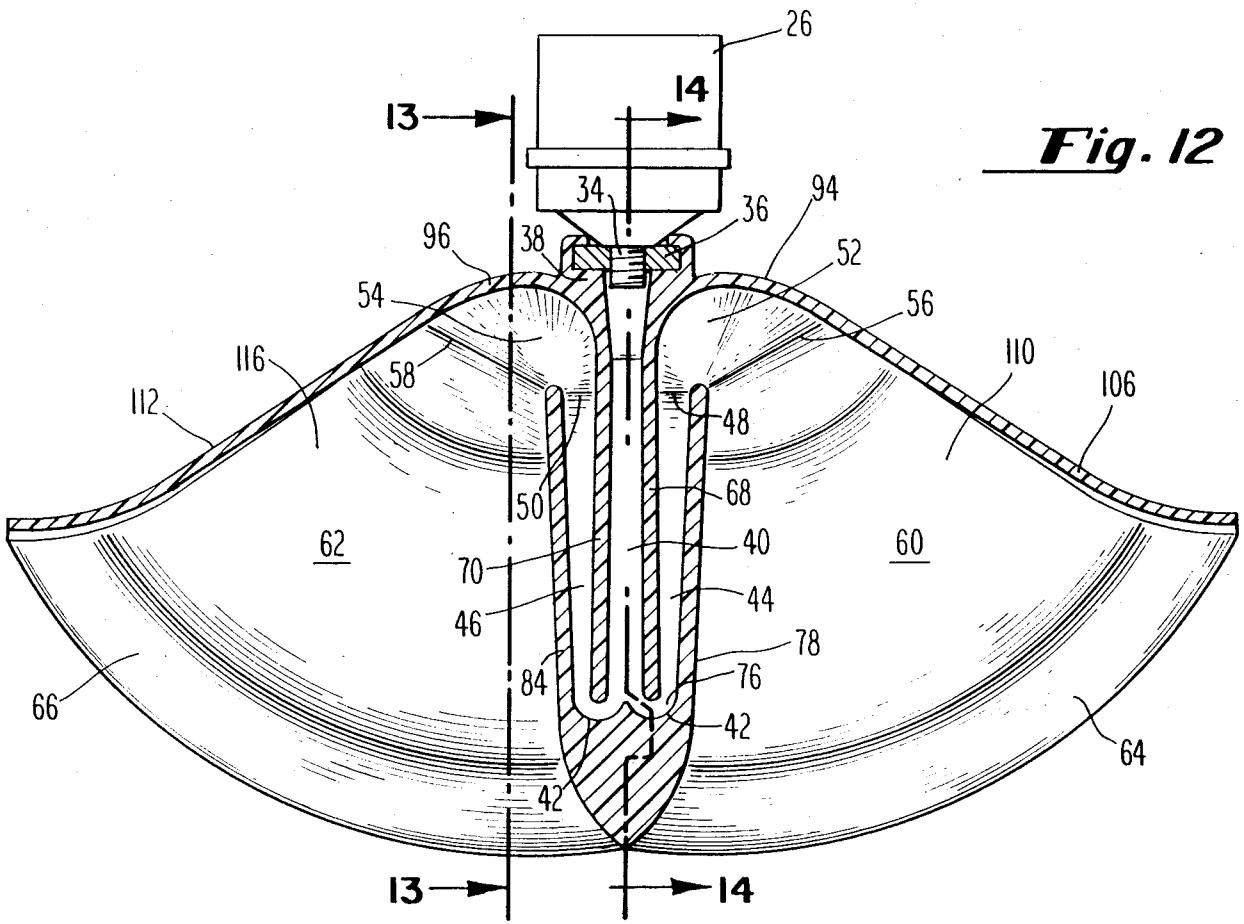
FIG. 12 is a plan view of the sectional view shown in FIG. 11.

Loudspeaker 20 is shown in FIG. 10 to be formed from two section halves 28 and 30 along line 32. Since loudspeaker halves 28 and 30 are mirror images of one another, the application will only describe loudspeaker half 28, as shown in FIGS. 11 and 12. Driver 26 is provided with a forward threaded portion 34 which threadingly engages nut 36 which has been securely mounted within throat 38. Throat 38 constitutes the input for loudspeaker 20.

An acoustic signal generated by driver 26 passes through throat 38 and into central channel 40. Positioned at the output end of central channel 40 is transition member 42 which serves to change the direction of the acoustical signal, creating two folded soundpaths. As indicated previously, loudspeaker 20 includes two horns 22 and 24. Each horn has associated with it a soundpath, i.e., the path which the acoustical signal follows while traversing the length of each horn. As will be appreciated from FIG. 12, the two soundpaths coincide within channel 40.

The cross-sectional area of channel 40 increases linearly outwardly along the coincident soundpaths. This increasing cross-sectional area relationship continues at the soundpath separation point in transition member 42. However, it should be noted that the cross-sectional area at any point along either soundpath in transition member 42 is greater than one half the maximum cross-sectional area in central channel 40.

The acoustical signal passes through transition member 42 and into a pair of side channels 44 and 46. It will be seen that the central channel 40, transition number 42 and side channels 44 and 46 form a so-called folded soundpath. The cross-sectional area of side channels 44 and 46 also increase linearly outwardly along each soundpath. It will be noted at this point, and will be discussed in more detail in relation to FIG. 14, that the cross-sectional area of output ends 48 and 50 of side channels 44 and 46 respectively, are defined by height and width dimensions, wherein the height is larger than the width.

The acoustical signal upon exiting side channels 44 and 46 enters a pair of second transition members 52 and 54. Transition members 52 and 54 serve to again change the direction of the soundpath away from driver 26. Transition Members 52 and 54 also have cross-sectional areas which increase uniformly outwardly along the soundpath.

Although not heretofore mentioned, when reference is made to cross-sectional area, such area is presumed to lie within a plane perpendicular to the soundpath.

Figure 13:
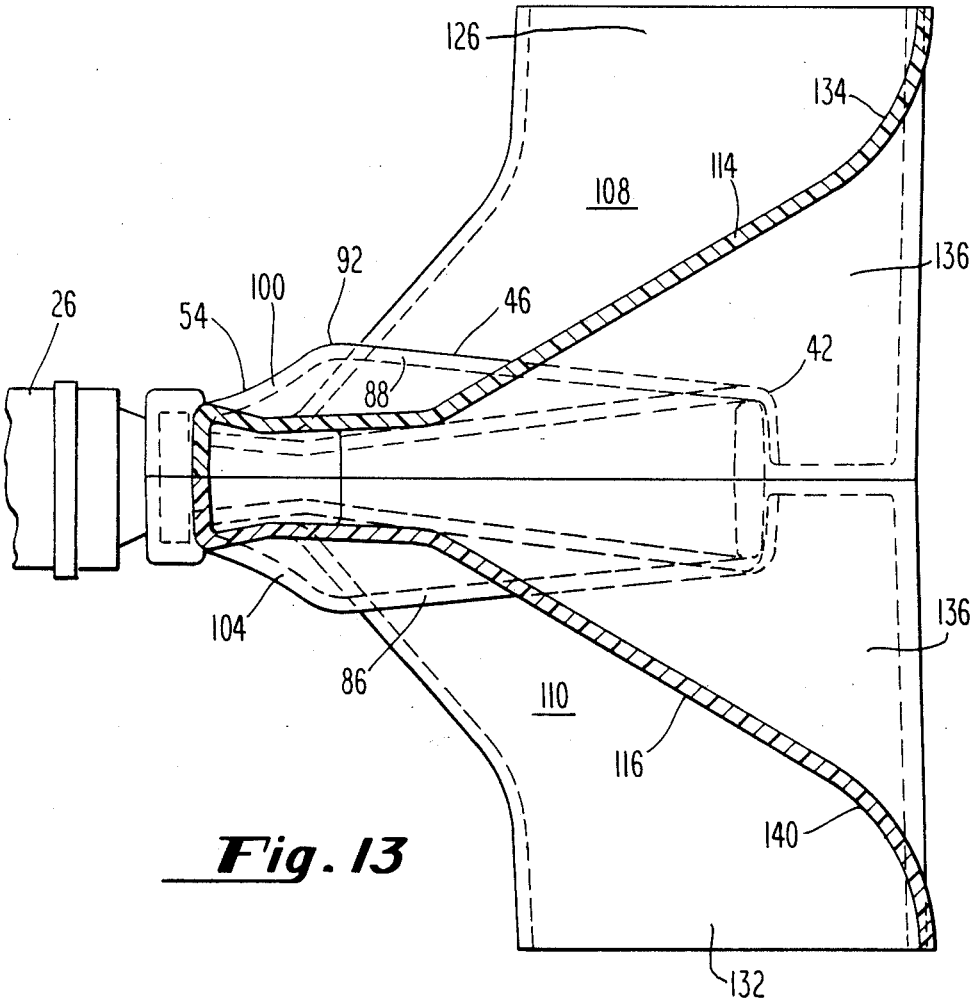
FIG. 13 is a sectional view taken along the line 13—13 in FIG. 12.
Figure 14:
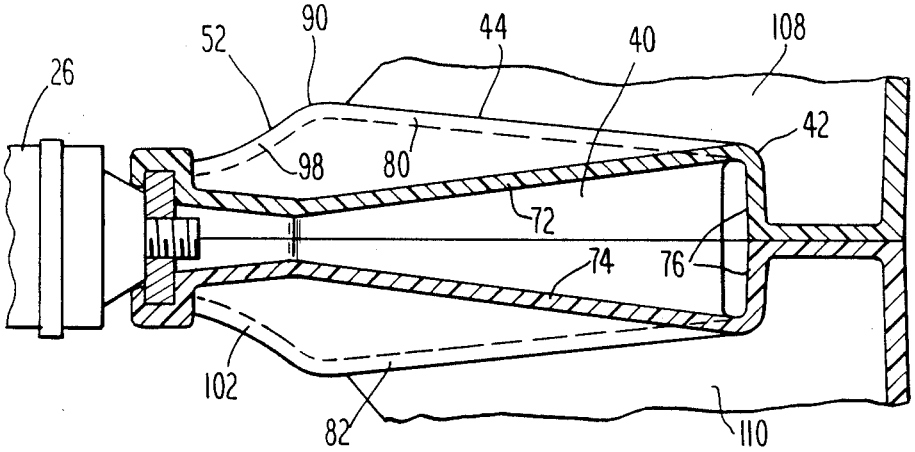
FIG. 14 is a sectional view taken along the line 14—14 in FIG. 12.

Another important feature of transition members 52 and 54 is that while cross-sectional area is increasing the aspect ratio is changing. Referring to FIGS. 11, 12 and 14, one can appreciate that the cross-sectional areas described thus far are generally rectangular having height and width dimensions. At output ends 48 and 50, the height dimension is larger than the width, more clearly seen in reference to FIGS. 11 and 14. At output end 56 and 58 of transition members 52 and 54, respectively, the aspect ratio has generally reversed. The width is now larger than the height. As can be seen in FIGS. 13 and 14, the height dimension actually decreases in transition members 54 and 52 respectively.

The acoustical signal upon passing through transition members 52 and 54 enters a pair of main channels 60 and 62. Main channels 60 and 62 also have a cross-sectional area which increases linearly outwardly along the soundpath. As can be appreciated, the rate of linear increase in cross-sectional area is largest in the main channel section.

Finally, the acoustical signal passes through a pair of flared outer channels 64 and 66. As shown in FIGS. 12 and 13, the walls of outer channels 64 and 66 follow a portion of an arc of a circle of constant radius. It will be noted from the above that at any point along the soundpath downstream from central channel 40, the cross-sectional area at that point is grater than any preceding cross-sectional area, excluding the cross-sectional area of channel 40, and is less than any subsequent cross-section area. It should further be noted that the cross-sectional area at any point along the soundpath downstream from channel 40 is greater than one half of the largest cross-sectional area within channel 40.

Consider now more particularly the structure of loudspeaker 20. As indicated previously loudspeaker 20 includes two half sections 28 and 30 joined in any suitable fashion along line 32. In the preferred embodiment each half section is integrally formed from a suitable plastic material. Referring now to FIGS. 10 through 14, it will be seen that channel 40 is defined by walls 68, 70, 72 and 74. Walls 68 and 70 are shown to be slightly sloped along the soundpath in central channel 40 relating to walls 72 and 74 which are shown to have greater scope along channel 40 creating a "tall and narrow" output. In transition member 42 the coincident soundpaths are split by the double curved wall 76 which folds the soundpath around walls 68 and 70 into side channels 44 and 46. Side channel 44 is shown to be defined by walls 68, 78, 80 and 82. Side channel 46 is shown to be defined by walls 70, 84, 86 and 88. As can be seen in each side channel, the vertical walls 68, 70, 78 and 84 are slightly sloped compared to horizontal walls 80, 82, 86 and 88. As will be appreciated, the cross-sectional area of each output 90 and 92 will again be tall and narrow.

Curved end walls 94 and 96 form one boundary of transition members 52 and 54 which folds the soundpaths around walls 78 and 84. As shown in FIGS. 13 and 14, top walls 98 and 100 and bottom walls 102 and 104 further define the transition members. While the inputs to transition members 52 and 54 are tall and narrow at 90 and 92, the outputs are short and wide. It should be noted that while the cross-sectional area of transition members 52 and 54 increases outwardly along the soundpaths, the height decreases.

Main channels 60 and 62, connected to the outputs of transition members 52 and 54 respectively, are defined by walls 78, 106, 108 and 110, and 84, 112, 114 and 116.

As will be appreciated, cross-sectional area increases along the soundpaths in these channels at a greater rate than in channels 40, 44 and 46. As shown in FIGS. 11 and 12, lobes 118 and 120 are formed in walls 110 and 116, respectively. Each lobe is shaped to present an arcuate downstream edge. The degree of curvature of this edge generally simulates the acoustic wavefront traveling along the soundpath. The arcuate shape of lobes 118 and 120 is carried forward to the output end of main channels 60 and 62 forming second lobes at the output of the main channels.

As shown in FIG. 11, intermediate channels 122 and 124 are proVided between the output of transition members 52 and 54 and main channels 60 and 62. It can be seen that lobes 118 and 120 form the output edge of channels 122 and 124, respectively. Although not shown, it should be understood that mirror images of lobes 118 and 120 are also formed in the portions of upper walls 108 and 114 which extend into intermediate channels 122 and 124.

Flared channels 64 and 66 are shown to be formed from walls 126, 128, 130 and 132 and 134, 136, 138 and 140, respectively. All of these walls follow the arc of a circle of constant radius. Walls 126, 132 and 134, 140 are also shown to follow in parallel the arcuate shape of lobes 118 and 120, respectively. Walls 128, 130, 136 and 138 all terminate along vertical lines.

Although the rate of increase of the cross-sectional area of center channel 40 and side channels 44 and 46 can be identical, in the preferred embodiment of the present invention the rate of increase in square inches/inch for each channel is not identical. The rate of increase for each channel is as follows:

| | |
|---|---|
| center channel 40 | 0.125 |
| transition member 42 | 0.0064 |
| side channels 44 and 46 | 0.1305 |
| transition members 52 and 54 | 0.024 |
| intermediate channels 122 and 124 | 4.30 |
| main channels 60 and 62 | 5.39 |

In flared channels 64 and 66 the cross-sectional area can be determined for any point along the soundpath according to the formula:

$$A = \left[ 2\left( d \tan \frac{\alpha}{4} + R(1 - \cos \theta) \right) \right]^2$$

where

A = cross-sectional area;

d = distance along the soundpath from the beginning of the outer channel;

$\alpha$ = beamwidth angle;

$\theta$ = angle of divergence which is the angle of the radius with respect to the beginning point of the flared channel; and R = said constant radius.

Figure 15A:
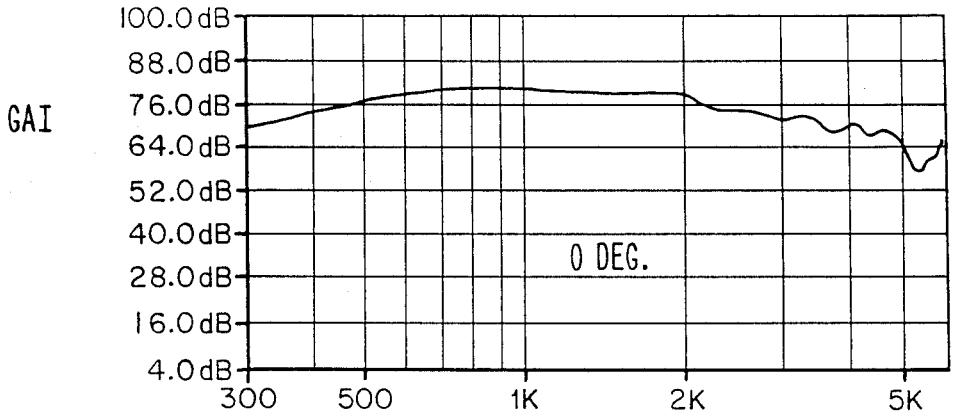
FIGS. 15*a* to 15*c* are graphs of response of the present invention.
Figure 15B:
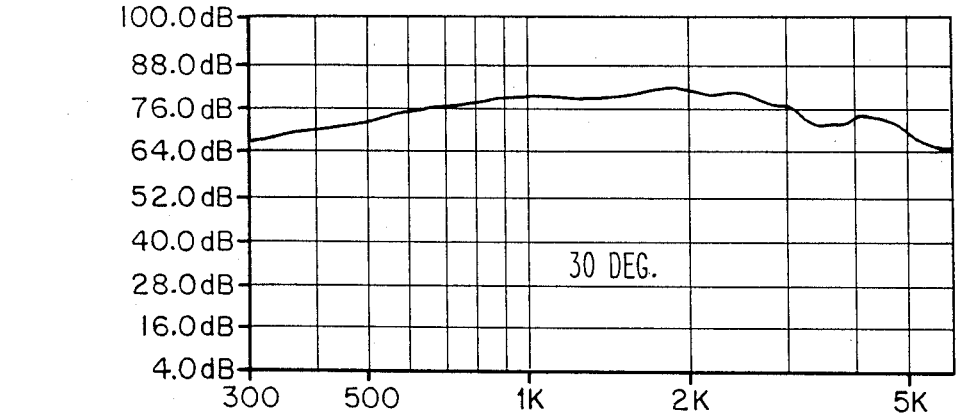
Figure 15C:
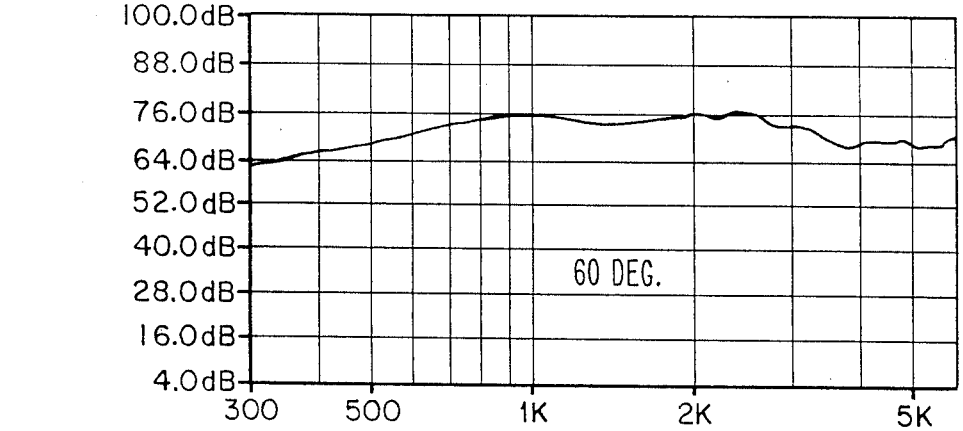
Figure 16A:
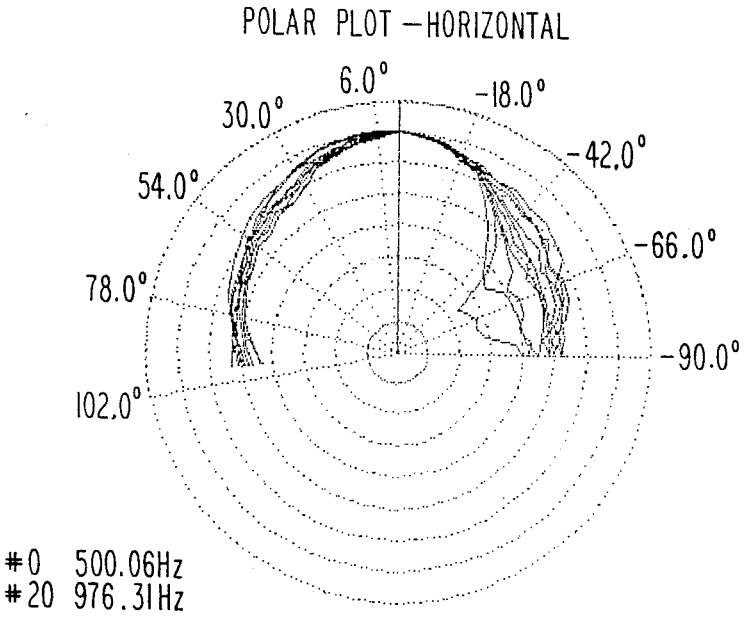
FIGS. 16*a* to 16*d* are polar graphs showing the horizontal beamwidth of the present invention.
Figure 16B:
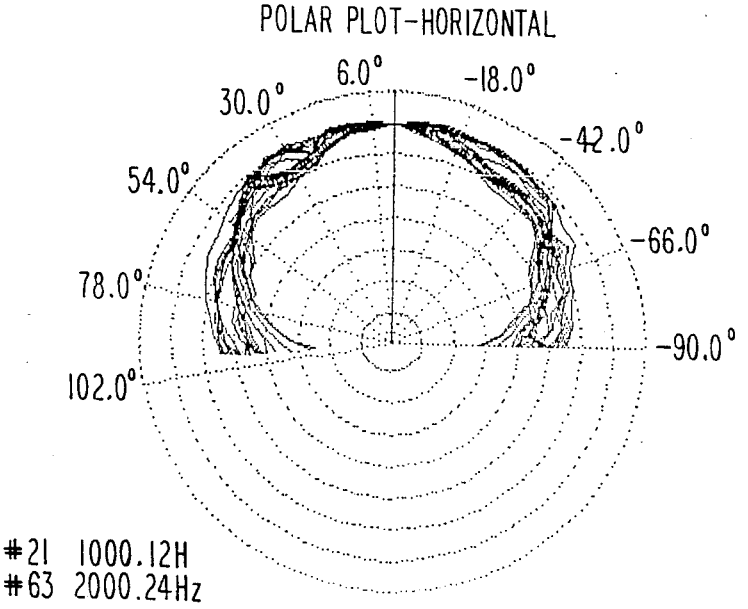
Figure 16C:
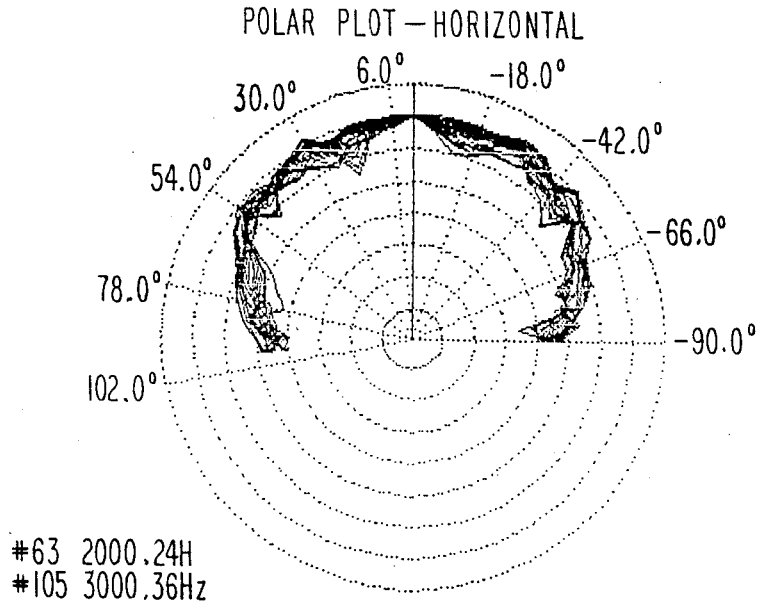
Figure 16D:
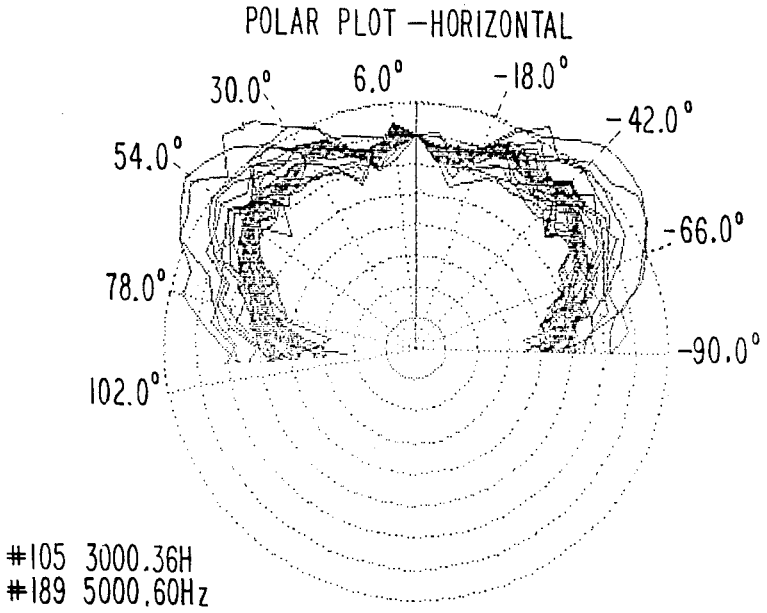
Figure 17A:
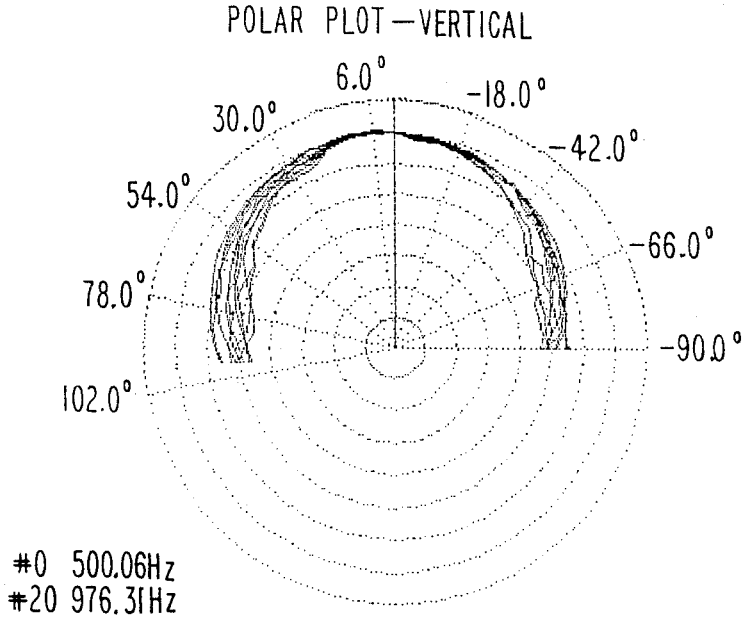
FIGS. 17*a* to 17*d* are polar graphs showing the vertical beamwidth of the present invention.
Figure 17B:
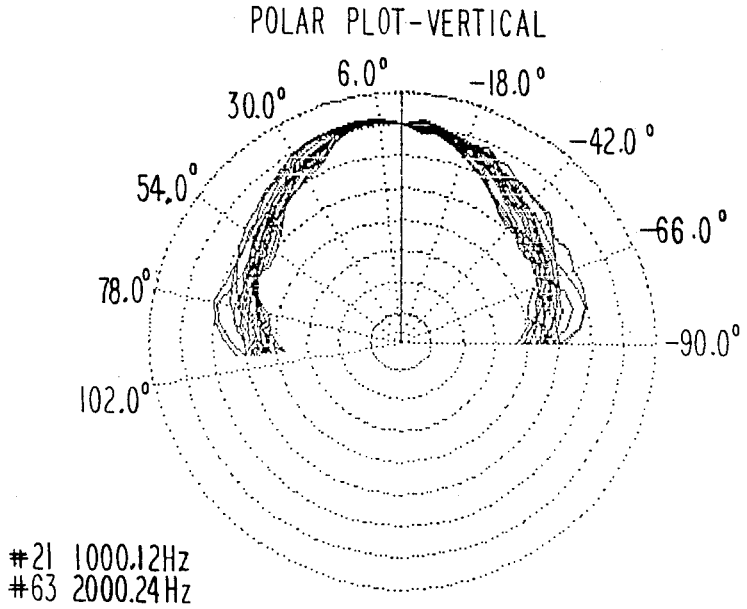
Figure 17C:
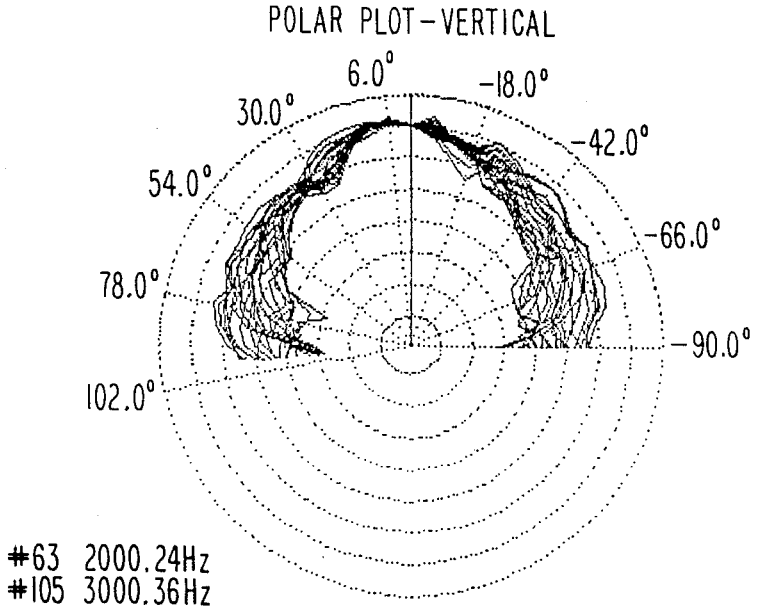
Figure 17D:
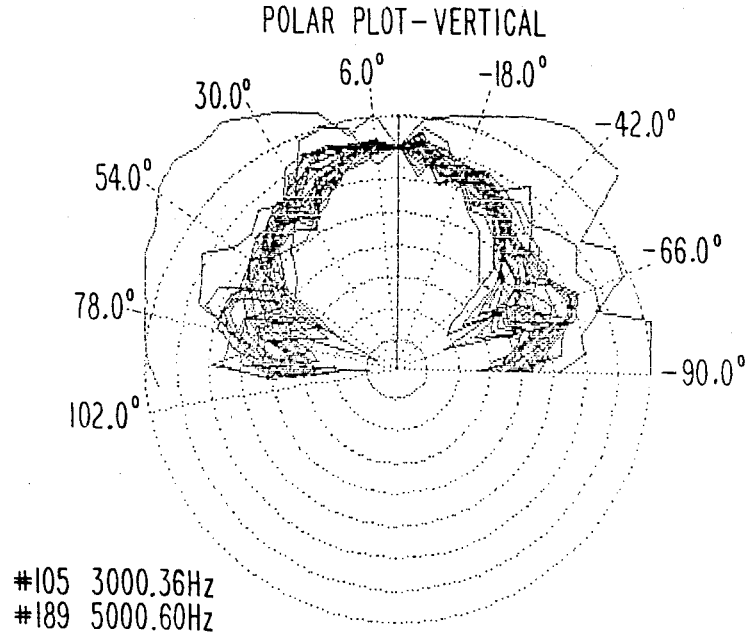

Consider now loudspeaker 20 during operation. In order to show the differences between loudspeaker 20 and the BIA, IIB and III described previously, the same tests were performed using the same driver. As shown in FIGS. 15*a*–15*c*, loudspeaker 20 yielded a substantially smoother and flatter response at 0°, 30°, and 60° from the reference direction. As shown in FIGS. 16*a* through 16*d*, loudspeaker 20 demonstrated a relatively constant horizontal beamwidth of 120° within the subject frequency range. As shown in FIGS. 17*a* through 17*d*, loudspeaker 20 demonstrated a vertical beamwidth of 60°.

While the invention has been described and illustrated with reference to specific embodiments, those skilled in the art will recognize that modification and variations may be made without departing from the principles of the invention as described herein above and set forth in the following claims.

What is claimed is:

1. A loudspeaker having first and second horns, said horns defining first and second soundpaths passing therethrough and an input for connection to a driver and an output for broadcasting an acoustic signal, comprising:

a central channel connected at one end to said input, said first and second soundpaths being directed through said central channel, said central channel having a cross-sectional area which increases outwardly along said soundpath;

a first transition member, connected to said central output, which defines separate channels for said first and second soundpaths, said separate channels serving to change the direction of said soundpaths, said separate channels having a cross-sectional area which increases outwardly along said soundpaths;

a pair of side channels, connected to said output ends of said separate channels, said central channel, said first transition member and said side channels forming a folded soundpath, said side channels having a cross-section which increases outwardly along said soundpath, the cross-section of the output ends of said side channels being defined by height and width dimensions, wherein said height and width dimensions define an aspect ratio;

a pair of second transition members, connected to said side channels, said second transition members serving to change the direction of said soundpaths and serving to reverse said aspect ratio, said second transition members having a cross-sectional area which increases outwardly along said soundpath;

a pair of main channels, connected to the output ends of said second transition members, said main channels having a cross-sectional area which increases outwardly along said soundpath; and a pair of flared outer channels, connected to the output ends of said main channels, said outer channels having walls flared along the arc of a circle of constant radius, so that at any point along said soundpath downstream from said central channel the cross-sectional area at that point is greater than any preceding cross-sectional area and less than any subsequent cross-sectional area.

2. The loudspeaker of claim 1, wherein the increase in the cross-sectional area along the soundpath is linear in said central channel, said first transition member, said side channels, said second transition members and said main channels.

3. The loudspeaker of claim 2, wherein said linear increase is identical for said central channel and said side channels.

4. The loudspeaker of claim 1, wherein the cross-sectional area at any point along said soundpath downstream from said central channel is greater than one-half of any preceding cross-sectional area.

5. The loudspeaker of claim 1, wherein said first dimension decreases along said soundpath within said second transition members.

6. The loudspeaker of claim 1, wherein said main channels are defined by walls, further comprising first lobes formed in said walls at the input of said main channels and second lobes formed at the output of said main channels.

7. The loudspeaker of claim 6, wherein said walls of said flared outer channel follow the shape of said second lobes.

8. The loudspeaker of claim 1, further comprising intermediate channels, interposed between said second transition members and said main channels, said intermediate channels having a cross-sectional area which increases along said soundpath which increase is at a rate less than the increase of cross-sectional area within said main channels.

9. The loudspeaker of claim 1, wherein the rate of increase of the cross-sectional area of said central channel is approximately 0.125 square inches/inch.

10. The loudspeaker of claim 1, wherein the rate of increase of the cross-sectional area of said first transition member channel is approximately 0.0064 square inches-/inch.

11. The loudspeaker of claim I, wherein the rate of increase of the cross-sectional area of said side channels is approximately 0.1305 square inches/inch.

12. The loudspeaker of claim 1, wherein the rate of increase of the cross-sectional area of said second transition members is approximately 0.024 square inches-/inch.

13. The loudspeaker of claim 1, wherein the rate of increase of the cross-sectional area of said main channels is approximately 5.39 square inches/inch.

14. The loudspeaker of claim 1, wherein the cross-sectional area at any point along said soundpath in said outer channels can be determined according to the formula:

$$A = \left[2\left(d \tan \frac{\alpha}{4} + R(1 - \cos \theta)\right)\right]^2$$

where

A=cross-sectional area;

d=distance along the soundpath from the beginning of the outer channel;

$\alpha$=beamwidth angle;

$\theta$=angle of divergence; and

R=said constant radius.

15. A loudspeaker having at least one horn defining a soundpath passing therethrough and having an input for connection to a driver and an output for broadcasting an acoustic signal, comprising;

a first channel, connected to said input, having a cross-sectional area which increases at a constant rate outwardly along said soundpath;

a folded second channel, downstream of said first channel, having a cross-sectional area which increases at a constant rate outwardly along said soundpath, the cross-section of the output end of said second channel being defined by height and width dimensions, wherein said height and width dimensions define an aspect ratio;

a folded third channel, downstream of said second channel, having a cross-sectional area which increases at a constant rate outwardly along said soundpath;

a transition member, connected between said second and third channels, for changing the direction of said soundpath and for reversing said aspect ratio, said transition member having a cross-sectional area which increases outwardly along said soundpath; and a flared outer channel, downstream of said third channel and forming said output, said outer channel having walls flared along the arc of a circle of constant radius, so that at any point along said soundpath the cross-sectional area at that point is greater than any preceding cross-sectional area and less than any subsequent cross-sectional area.

16. The loudspeaker of claim 15, comprising a second horn identical to said first horn except that the direction of the soundpath of said second horn at the output is at an angle divergent from said first soundpath.

17. The loudspeaker of claim 16, wherein the first channel of said first and second horns is common.

18. The loudspeaker of claim 15, wherein the rate of increase of the cross-sectional areas of said first and second channels is the same.

19. The loudspeaker of claim 15, wherein the rate of increase of the cross-sectional areas of said first, second and third channels is different.

20. A loudspeaker having at least one horn defining a soundpath passing therethrough and having an input for connection to a driver and an output for broadcasting an acoustic signal, comprising:

a first channel, connected to said input, having a cross-sectional area which increases outwardly along said soundpath;

a folded second channel, downstream of said first channel, having a cross-sectional area which increases outwardly along said soundpath, the cross-section of the output end of said second channel being defined by height and width dimensions, wherein said height and width dimensions define an aspect ratio;

a folded third channel, downstream of said second channel, having a cross-sectional area which increases outwardly along said soundpath; and a transition member, connected between said second and third channels, for changing the direction of said soundpath and for reversing said aspect ratio, said transition member having a cross-sectional area which increases outwardly along said soundpath.

21. The loudspeaker of claim 20, wherein the height dimension is greater than the width dimension in said folded second channel.

22. The loudspeaker of claim 21, wherein said height dimension decreases in said transition member.

* * * * *